US008334829B2

(12) United States Patent
Hsu et al.

(10) Patent No.: US 8,334,829 B2
(45) Date of Patent: Dec. 18, 2012

(54) LCD DEVICE WITH AN IMPROVEMENT OF MURA IN PIXEL MATRIX AND DRIVING METHOD FOR THE SAME

(75) Inventors: Ya-ting Hsu, Hsin-Chu (TW); Chi-mao Hung, Hsin-Chu (TW); Ken-ming Chen, Hsin-Chu (TW); Yao-jen Hsieh, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 366 days.

(21) Appl. No.: 12/544,544

(22) Filed: Aug. 20, 2009

(65) Prior Publication Data

US 2010/0182289 A1 Jul. 22, 2010

(30) Foreign Application Priority Data

Jan. 17, 2009 (TW) ..... 98101837 A

(51) Int. Cl.
*G09G 3/36* (2006.01)

(52) U.S. Cl. ..... 345/92

(58) Field of Classification Search ..... 345/87, 345/204, 205, 698, 92
See application file for complete search history.

(56) References Cited

U.S. PATENT DOCUMENTS

| | | | | |
|---|---|---|---|---|
| 5,448,258 | A * | 9/1995 | Edwards | 345/90 |
| 7,319,504 | B2 | 1/2008 | Liu et al. | |
| 2006/0164350 | A1 * | 7/2006 | Kim et al. | 345/87 |
| 2008/0024406 | A1 | 1/2008 | Kim et al. | |
| 2008/0062092 | A1 | 3/2008 | Kanda | |

FOREIGN PATENT DOCUMENTS

| | | |
|---|---|---|
| CN | 1808250 | 7/2006 |
| TW | 200737106 | 10/2007 |
| TW | 200813578 | 3/2008 |
| TW | 200830260 | 7/2008 |

* cited by examiner

*Primary Examiner* — Chanh Nguyen
*Assistant Examiner* — Ram Mistry

(57) ABSTRACT

A liquid crystal display and method for driving the same are proposed. The liquid crystal display includes a pixel matrix. The pixel matrix includes two first pixel groups each having a first pixel and a second pixel are at one side of the data line, and two second pixel groups each having a third pixel and a fourth pixel are at the other side of the data line. The driving method includes steps of: driving one of the two second pixel groups to transmit a first signal to a fourth pixel of the driven second pixel group, driving one of the two first pixel groups to transmit a second signal to a first pixel of the driven first pixel group, driving the other second pixel group to transmit a third signal to a fourth pixel of the other second pixel group, and driving the second group to transmit a fourth signal to a third pixel of the driven second pixel group.

6 Claims, 6 Drawing Sheets

LCD DEVICE WITH AN IMPROVEMENT OF MURA IN PIXEL MATRIX AND DRIVING METHOD FOR THE SAME

RELATED APPLICATIONS

This application claims priorities to Taiwan Application Serial Number 98101837, filed Jan. 17, 2009, which are herein incorporated by reference.

BACKGROUND OF THE INVENTION

1. Field of the Invention

The present invention relates to a liquid crystal display and its driving method, and more particularly, to a liquid crystal display for eliminating MURA in a pixel matrix and driving method for the same.

2. Description of the Related Art

With a rapid development of monitor types, novel and colorful monitors with high resolution, e.g., liquid crystal displays (LCDs), are indispensable components used in various electronic products such as monitors for notebook computers, personal digital assistants (PDAs), digital cameras, and projectors. The demand for the novelty and colorful monitors has increased tremendously.

Referring to FIG. 1 showing a functional block diagram of a conventional liquid crystal display 10 using half source driver (HSD) technique, the liquid crystal display 10 includes a pixel matrix 12, a gate driver 14, and a source driver 16. The pixel matrix 12 includes a plurality of pixels, each pixel having three pixel units 20 indicating three primary colors, red, green, and blue. For example, the pixel matrix 12 with 1024 by 768 pixels contains a number of 1024×768×3 pixel units 20. The gate driver 14 periodically outputs a scanning signal to turn on each transistor 22 of the pixel units 20 row by row, meanwhile, each pixel units 20 is charged to a corresponding voltage based on a data signal from the source driver 16, to show various gray levels. After a row of pixel units is finished to be charged, the gate driver 14 stops outputting the scanning signal to this row, and then outputs the scanning signal to turn on the transistors 22 of the pixel units of the next row. Sequentially, until all pixel units 20 of the pixel matrix 12 finish charging, and the gate driver 14 outputs the scanning signal to the first row again and repeats the above-mentioned mechanism.

As to the conventional liquid crystal display, the gate driver 14 functions as a shift register. In other words, the gate driver 16 outputs a scanning signal to the pixel matrix 12 at a fixed interval. For instance, a pixel matrix 12 with 1024×768 pixels and its operating frequency with 60 Hz is provided, the display interval of each frame is about 16.67 ms (i.e., 1/60 second), such that an interval between two scanning signals applied on two row adjacent lines is about 21.7 μs (i.e., 16.67 ms/768). The pixel units 20 are charged and discharged by data voltage from the source driver 16 to show corresponding gray levels in the time period of 21.7 μs accordingly.

Referring to FIG. 1 and taking pixels T1-T8 as an example, during one frame time, pixels T1, T3, T6, T8 which directly couples to the source driver 16 are charged twice, whereas pixels T2, T4, T5, T7 which indirectly couples to the source driver 16 are charged once. Due to different and uniform charged times of the pixels T1-T8, MURA in the pixel matrix 12 is induced as shown in FIG. 2 which illustrates an exaggerated diagram. There are several straight lines in a single gray level frame, thereby weakening an image quality.

SUMMARY OF THE INVENTION

It is therefore an object of the present invention to provide a liquid crystal display and its driving method to eliminate MURA in the pixel matrix, and therefore to solve the above-mentioned problem existing in the prior art.

According to the present invention, a liquid crystal display comprises a pixel matrix. The pixel matrix comprises a first scan line, a second scan line, and a third scan line, arranged in parallel to each others, and a data line overlap the first scan line, the second scan line, and the third scan line. At least two first pixel groups are neighbored with each other and at one side of the data line, and each first pixel group comprises a first pixel and a second pixel. At least two second pixel groups are neighbored with each other and at the other side of the data line, and each second pixel group comprises a third pixel and a fourth pixel. The first pixel comprises a first active element coupled to the first scan line and the data line, the second pixel comprises a second active element coupled to the second scan line and the first active element, the third pixel comprises a third active element coupled to the second scan line and the data line, the fourth pixel comprises a fourth active element coupled to the third scan line and the third active element.

In one aspect of the present invention, a method of driving the liquid crystal display comprises: driving one of the at least two second pixel groups to transmit a first signal to the fourth pixel and a second signal to the third pixel via the data line; driving another second pixel group to transmit the first signal to the fourth pixel and the second signal to the third pixel via the data line; driving one of the at least two first pixel groups to transmit a third signal to the second pixel and a fourth signal to the first pixel via the data line; and driving another first pixel group to transmit the third signal to the second pixel and the fourth signal to the first pixel via the data line.

In another aspect of the present invention, a method of driving the liquid crystal display comprises the steps of: driving one of the at least two second pixel groups, to transmit a first signal to the fourth pixel via the data line; driving one first pixel of one of the at least two first pixel groups, to transmit a second signal to the first pixel via the data line; driving another second pixel group, to transmit via the data line a third signal to another fourth pixel; and driving the third pixel of the at least two second pixel group, to transmit a fourth signal to the third pixel via the data line.

These and other objectives of the present invention will become apparent to those of ordinary skill in the art after reading the following detailed description of the preferred embodiment that is illustrated in the various figures and drawings.

DETAILED DESCRIPTION OF THE PREFERRED EMBODIMENTS

Figure 1:
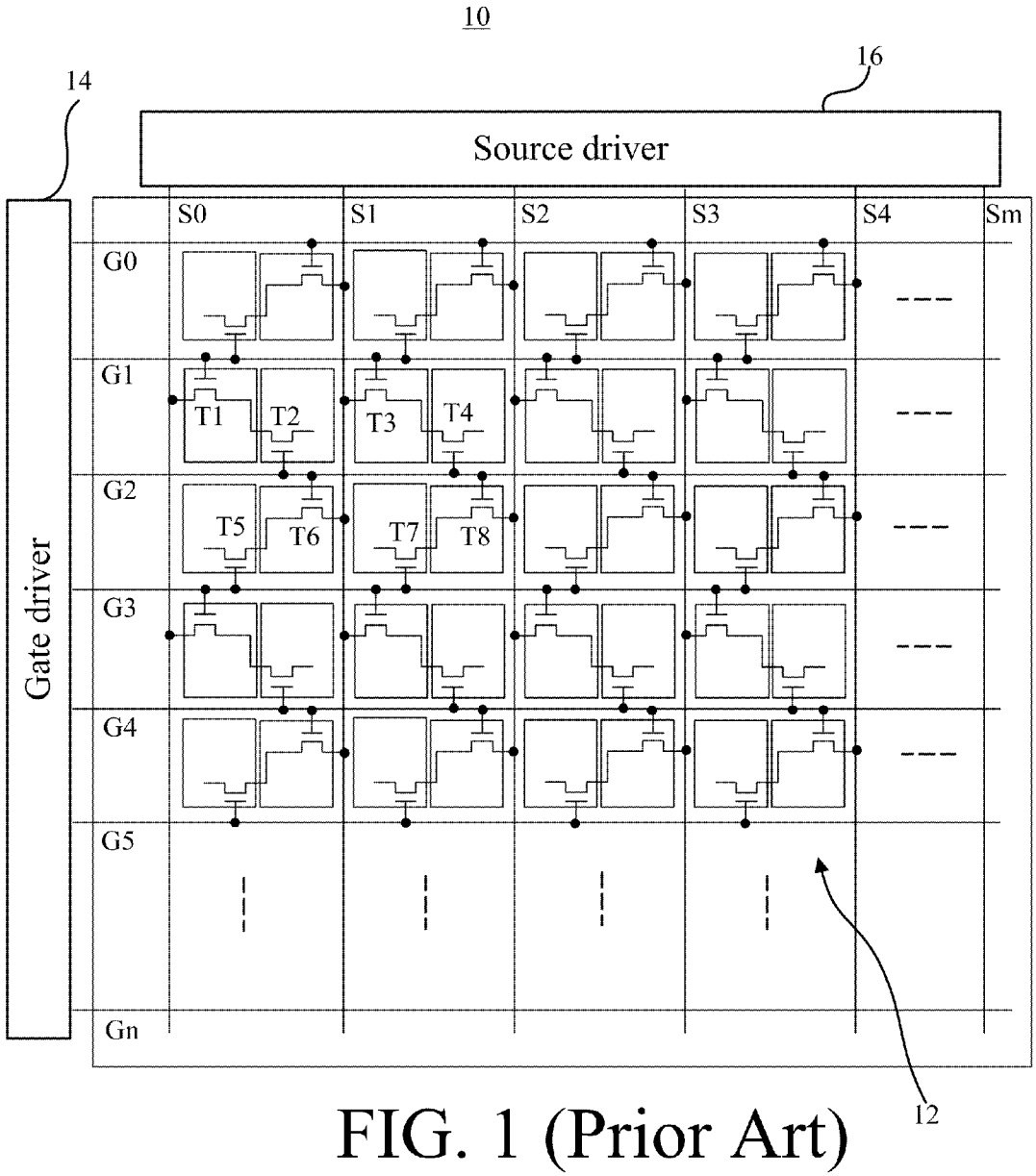
FIG. 1 (Prior Art)
FIG. 1 showing a functional block diagram of a conventional liquid crystal display using half source driver (HSD) technique.
Figure 2:
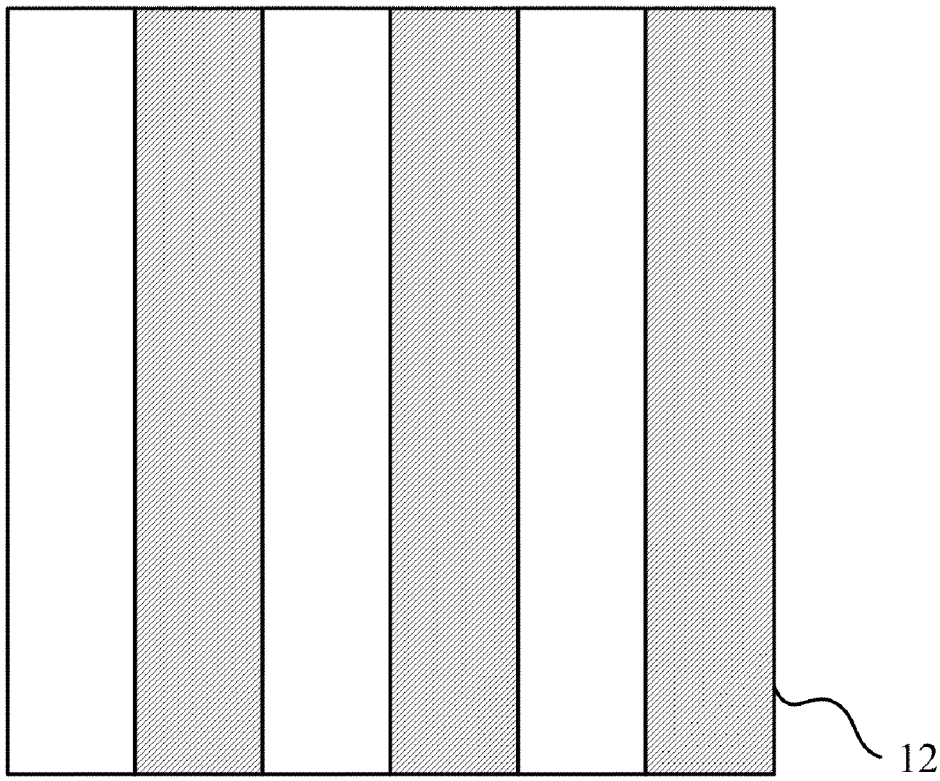
FIG. 2 (Prior Art)
FIG. 2 shows an exaggerated diagram of MURA in the pixel matrix.
Figure 3:
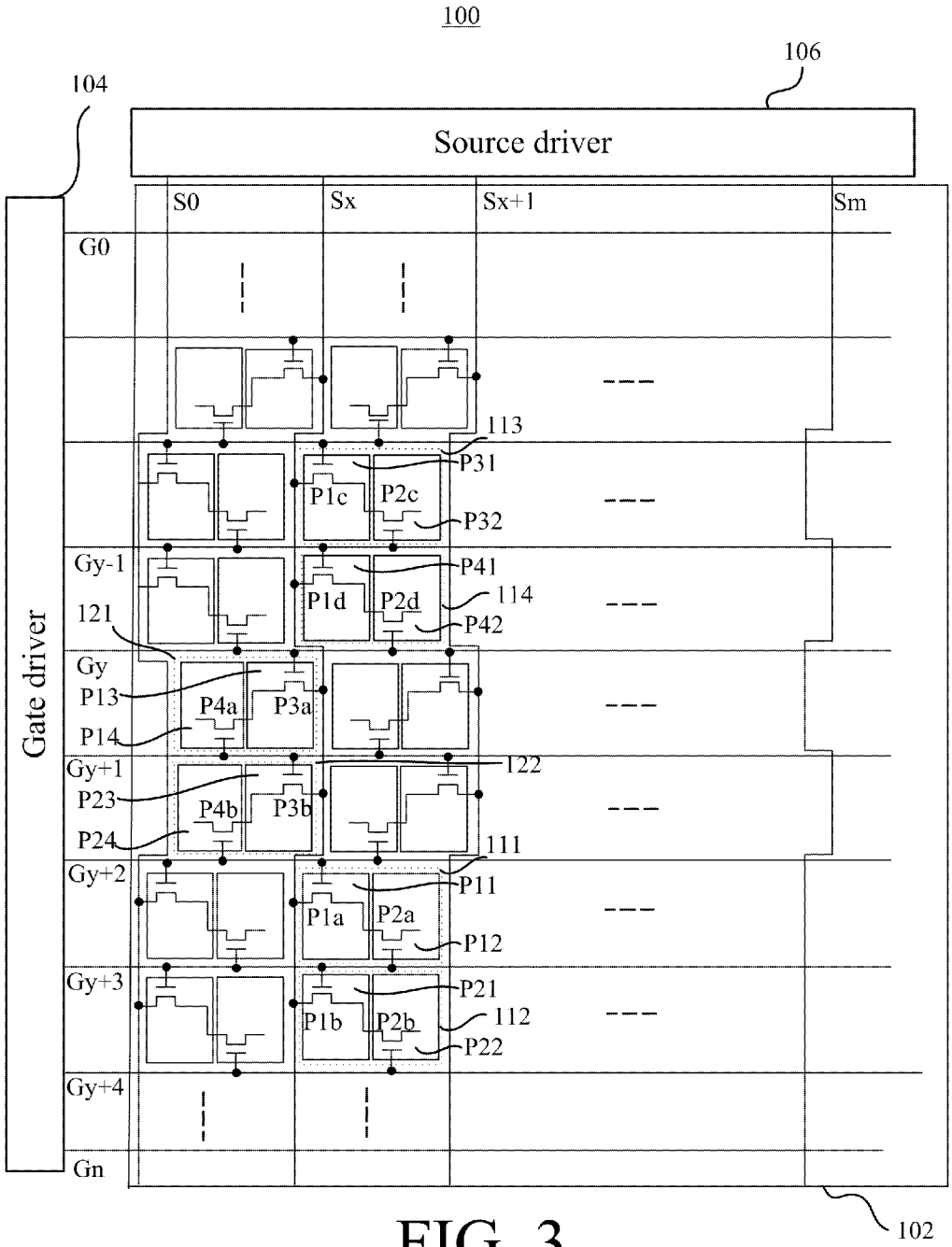
FIG. 3 shows an LCD device according to a preferred embodiment of the present invention.

Referring to FIG. 3, showing an LCD device 100 according to a preferred embodiment of the present invention, the LCD device 100 includes a pixel matrix 102, a gate driver 104, and a source driver 106. The pixel matrix 102 comprises a plurality of pixels, and each pixel comprises at least three pixel units for displaying red, green, and blue (RGB). The gate driver 104 outputs scan signals row by row to pixel units via the scan lines G0-Gn, meanwhile the source driver 106 outputs data signals row by row via the data lines S0-Sm to the charge pixels to show various levels. In this embodiment, the pixel matrix 102 is arranged in a delta RGB alignment and in a zigzag pixel design, in cooperation with the liquid crystal display 100 using half source driver (HSD) technique.

For simplicity, take part of pixel matrix 102 as an example to explain the present invention. The pixel matrix 102 comprises a first scan line Gy, a second scan line Gy+1, a third scan line Gy+2, a fourth scan line Gy+3, a fifth scan line Gy+4, and a data line Sx. Two first pixel groups 111, 112 are at one side of the data line Sx. The first pixel group 111 comprises a first pixel P11 and a second pixel P12. The first pixel group 112 comprises a first pixel P21 and a second pixel P22. Two second pixel group 121, 122 are at the other side of the data line Sx. The second pixel group 121 comprises a third pixel P13 and a fourth pixel P14. The second first pixel group 122 comprises a third pixel P23 and a fourth pixel P24.

The first pixel P1 comprises a first active element P1*a* coupled to the third scan line Gy+2 and the data line Sx. The second pixel P12 comprises a second active element P2*a* coupled to the fourth scan line Gy+3 and the first active element P1*a*. The first pixel P21 comprises a first active element P1*b* coupled to the fourth scan line Gy+3 and the data line Sx. The second pixel P22 comprises a second active element P2*b* coupled to the fifth scan line Gy+4 and the first active element P1*b*. The third pixel P13 comprises a third active element P3*a* coupled to the first scan line Gy and the data line Sx. The second pixel P14 comprises a fourth active element P4*a* coupled the second scan line Gy+1 and the third active element P3*a*. The third pixel P23 comprises a third active element P3*b* coupled to the second scan line Gy+1 and the data line Sx. The fourth pixel P24 comprises a fourth active element P4*b* coupled to the third scan line Gy+2 and the third active element P3*b*. Two first pixel groups and two second pixel groups are arranged at two sides of the data line Sx. As shown in FIG. 3, the second pixel groups 121, 122 are at the left side of the data line Sx, and the first pixel groups 111, 112 are at the right side of the data line Sx.

Figure 4:
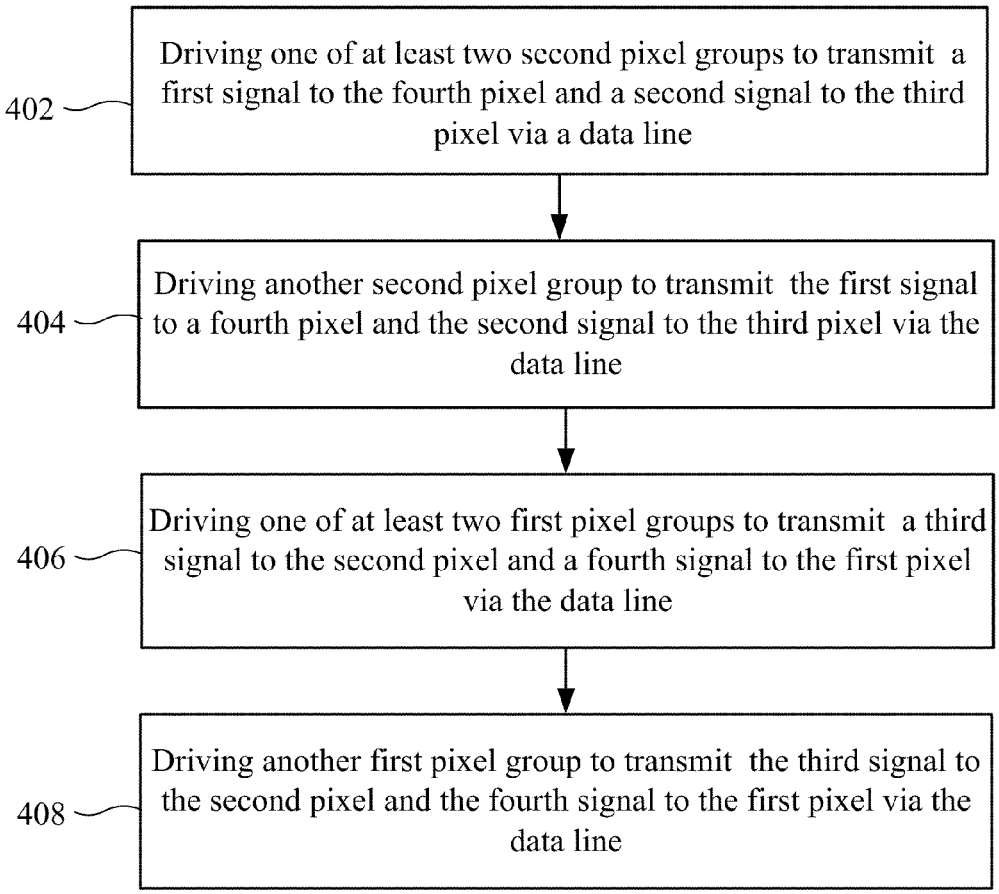
FIG. 4 illustrates a method of driving the LCD device shown in FIG. 3.

Referring to FIG. 3 and FIG. 4 illustrating a method of driving the LCD device shown in FIG. 3, the method comprises steps of:

Step 402: Driving the second pixel group 121 to transmit a first signal to the fourth pixel P14 and a second signal to the third pixel P13 via the data line Sx.

Step 404: Driving the second pixel group 122 to transmit the first signal to a fourth pixel P24 and the second signal to the third pixel P23 via the data line Sx.

Step 406: Driving the first pixel group 111 to transmit a third signal to the second pixel P12 and a fourth signal to the first pixel P11 via the data line Sx.

Step 408: Driving the first pixel group 112 to transmit the third signal to the second pixel P22 and the fourth signal to the first pixel P21 via the data line Sx.

In Steps 402 and 404, preferably, the first signals transmitted to the fourth pixels P14 and P24 are identical, but as one skilled in this art is aware, the signals transmitted to the fourth pixels P14 and P24 may be different depending on the design requirement. Similarly, in Steps 402 and 404, the second signals transmitted to the third pixels P13 and P23 are identical; in Steps 406 and 408, the third signals transmitted to the second pixels P12 and P22 are identical, the fourth signals transmitted to the first pixels P11 and P21.

Figure 5:
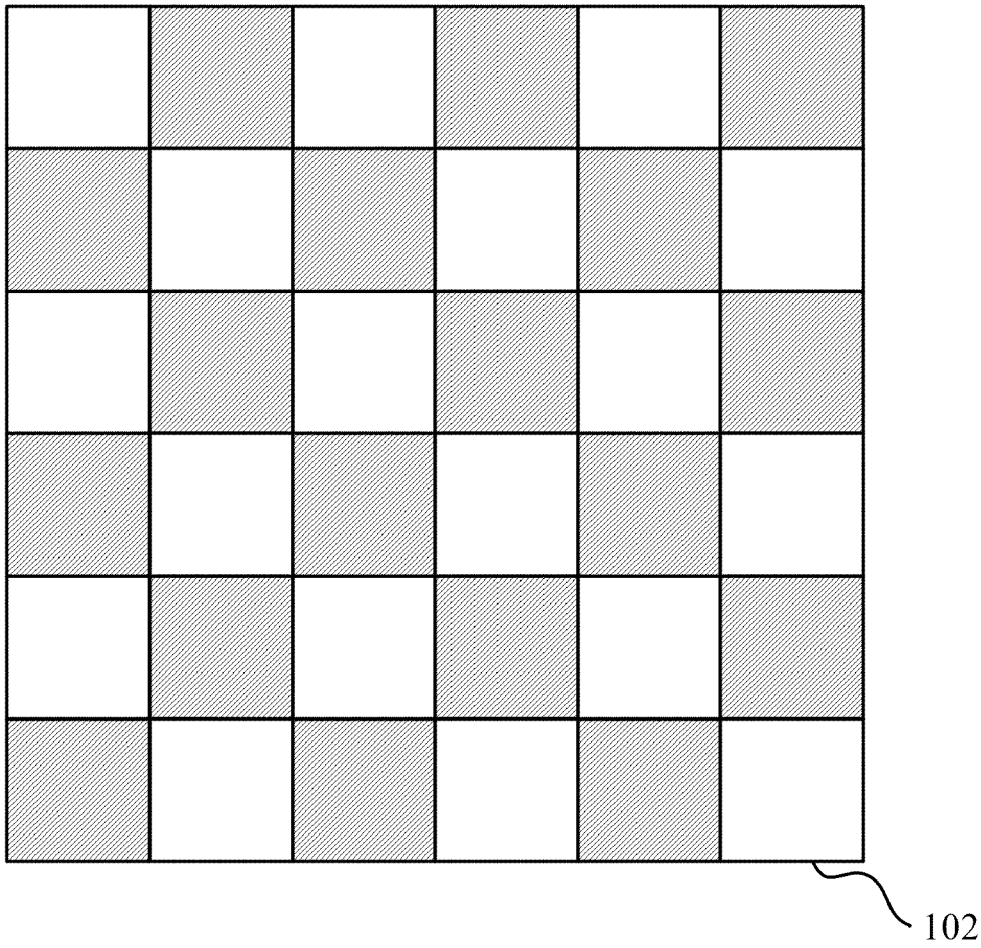
FIG. 5 shows an exaggerated diagram of a MURA in the pixel matrix.

The gate driver 104 sends scan signals via the scan lines Gy, Gy+1 to turn on the active elements P3*a*, P4*a* of the second pixel group 121, meanwhile the source driver 106 sends a first signal via the data line Sx through the turned-on active elements P3*a*, P4*a* to the fourth pixel P14 (Step 402), so that the third pixel P13 and the fourth pixel P14 display a gray level based on the first signal. Then, the gate driver 104 sends scan signal via the scan line Gy to turn on the active element P3*a* of the second pixel group 121, meanwhile the source driver 106 sends a second signal via the data line Sx through the turned-on active element P3*a* to the third pixel P13. The gate driver 104 sends scan signals via the scan lines Gy+1, Gy+2 to turn on the active elements P3*b*, P4*b* of the second pixel group 122, meanwhile the source driver 106 sends the first signal via the data line Sx through the turned-on active elements P3*b*, P4*b* to the fourth pixel P24 (Step 404), so that the third pixel P23 and the fourth pixel P24 display a gray level based on the first signal. Then, the gate driver 104 sends scan signal via the scan line Gy+1 to turn on the active element P3*b* of the second pixel group 122, meanwhile the source driver 106 sends a second signal via the data line Sx through the turned-on active element P3*b* to the third pixel P23. The gate driver 104 sends scan signals via the scan lines Gy+2, Gy+3 to turn on the active elements P1*a*, P2*a* of the first pixel group 111, meanwhile the source driver 106 sends the third signal via the data line Sx through the turned-on active elements P1*a*, P2*a* to the first pixel P12 (Step 406), so that the first pixel P11 and the second pixel P12 display a gray level based on the third signal. Then, the gate driver 104 sends scan signal via the scan line Gy+2 to turn on the active element P1*a* of the first pixel group 111, meanwhile the source driver 106 sends a fourth signal via the data line Sx through the turned-on active element P1*a* to the first pixel P11. The gate driver 104 sends scan signals via the scan lines Gy+3, Gy+4 to turn on the active elements P1*b*, P2*b* of the first pixel group 112, meanwhile the source driver 106 sends the third signal via the data line Sx through the turned-on active elements P1*b*, P2*b* to the first pixel P22 (Step 408), so that the first pixel P21 and the second pixel P22 display a gray level based on the third signal. Then, the gate driver 104 sends scan signal via the scan line Gy+3 to turn on the active element P1*b* of the first pixel group 112, meanwhile the source driver 106 sends the fourth signal via the data line Sx through the turned-on active element P1*b* to the first pixel P21. All pixels of the pixel matrix 102 are charged by repeating the above-mentioned mechanism in a frame time. Please refer to FIGS. 3 and 5, FIG. 5 shows an exaggerated diagram of MURA in the pixel matrix 102. During a frame time, the pixels P11, P21, P13, P23 directly coupled to the data line Sx, are charged twice, whereas the pixels P12, P22, P14, P24 indirectly coupled to the data line Sx, are charged once. This results in a checker-like pattern as shown in FIG. 5 when displaying a single gray level frame. In contrast to straight lines, the vision of the checker-like pattern is not obvious for human. Accordingly, the image displayed by the LCD device 100 is better than conventional LCD.

Figure 6:
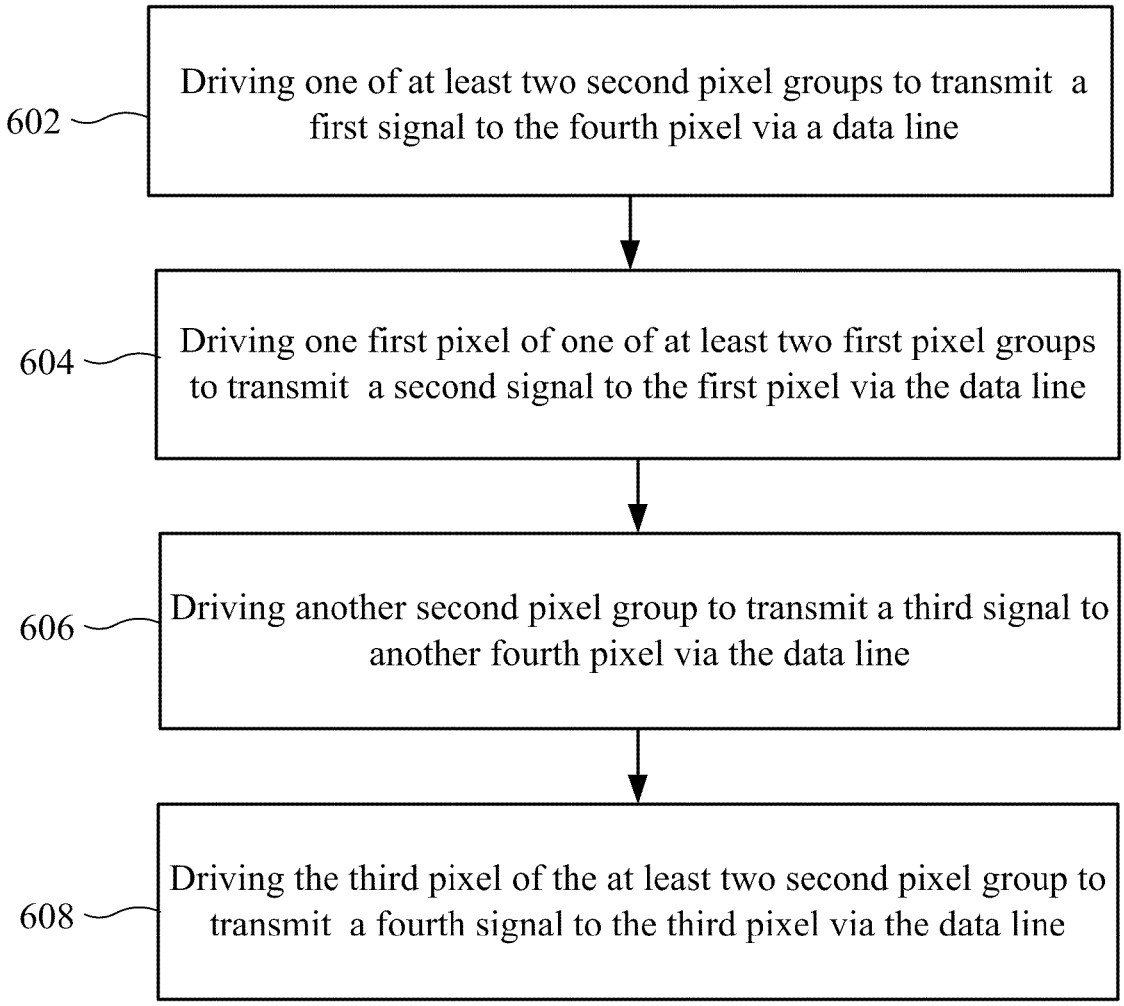
FIG. 6 illustrates another method of driving the LCD device shown in FIG. 3

Referring to FIG. 3 and FIG. 6 illustrating another method of driving the LCD device shown in FIG. 3, the method comprises steps of:

Step 602: Driving the second pixel group 121 to transmit a first signal to the fourth pixel P14 via the data line Sx.

Step 604: Driving the first pixel group 114 to transmit a second signal to the first pixel P41 via the data line Sx.

Step 606: Driving the second pixel group 122 to transmit a third signal to the fourth pixel P24 via the data line Sx.

Step 608: Driving the second pixel group 121 to transmit a fourth signal to the third pixel P13 via the data line Sx.

In Step 602, in a duration of driving the second pixel group 121 to transmit the first signal to the fourth pixel P14, scan signals are simultaneously transmitted via the scan lines Gy, Gy+1 to turn on the third active element P3*a* and the fourth active element P4*a*. In Step 606, in a duration of driving the second pixel group 122 to transmit the third signal to the fourth pixel P24, scan signals are simultaneously transmitted via the scan lines Gy+1, Gy+2 to turn on the third active element P3*b* and the fourth active element P4*b*.

The gate driver 104 sends scan signals via the scan lines Gy, Gy+1 to turn on the active elements P3*a*, P4*a* of the second pixel group 121, meanwhile the source driver 106 sends a first signal via the data line Sx through the turned-on active elements P3*a*, P4*a* to the fourth pixel P14 (Step 602), so that the third pixel P13 and the fourth pixel P14 display a gray level based on the first signal. Then, the gate driver 104 sends scan signal via the scan line Gy−1 to turn on the active element P1*d* of the first pixel group 114, meanwhile the source driver 106 sends a second signal via the data line Sx through the turned-on active element P1*d* to the first pixel P41, so that the first pixel P41 display a gray level based on the second signal. The gate driver 104 sends scan signals via the scan lines Gy+1, Gy+2 to turn on the active elements P3*b*, P4*b* of the second pixel group 122, meanwhile the source driver 106 sends a third signal via the data line Sx through the turned-on active elements P3*b*, P4*b* to the fourth pixel P24 (Step 606), so that the third pixel P23 and the fourth pixel P24 display a gray level based on the third signal. Then, the gate driver 104 sends scan signal via the scan line Gy to turn on the active element P3*a* of the second pixel group 121, meanwhile the source driver 106 sends a fourth signal via the data line Sx through the turned-on active element P3*a* to the third pixel P13.

Afterwards, the gate driver 104 sends scan signals via the scan lines Gy+3, Gy+2 to turn on the active elements P2*a*, P1*a* of the second pixel group 121, meanwhile the source driver 106 sends a fifth signal via the data line Sx through the turned-on active elements P2*a*, P1*a* to the second pixel P12, so that the first pixel P11 and the second pixel P12 display a gray level based on the fifth signal. Then, the gate driver 104 sends scan signal via the scan line Gy+2 to turn on the active element P3*b* of the second pixel group 122, meanwhile the source driver 106 sends a sixth signal via the data line Sx through the turned-on active element P3*b* to the third pixel P23, so that the third pixel P23 display a gray level based on the sixth signal. The gate driver 104 sends scan signals via the scan lines Gy+3, Gy+4 to turn on the active elements P1*b*, P2*b* of the first pixel group 112, meanwhile the source driver 106 sends a seventh signal via the data line Sx through the turned-on active elements P1*b*, P2*b* to the second pixel P22, so that the first pixel P21 and the second pixel P22 display a gray level based on the seventh signal. Then, the gate driver 104 sends scan signal via the scan line Gy+2 to turn on the active element P1*a* of the first pixel group 111, meanwhile the source driver 106 sends an eighth signal via the data line Sx through the turned-on active element P1*a* to the first pixel P11.

All pixels of the pixel matrix 102 are charged by repeating the above-mentioned mechanism in a frame time. No matter the driving method disclosed in FIG. 4 or FIG. 6 is adapted, during a frame time, the pixels P11, P21, P13, P23, P31, P41 directly coupled to the data line Sx, are charged twice, whereas the pixels P12, P22, P14, P24, P32, P42 indirectly coupled to the data line Sx, are charged once. This results in a checker-like pattern as shown in FIG. 5 when displaying a single gray level frame. In contrast to straight lines, the vision of the checker-like pattern is not obvious for human. Accordingly, the image displayed by the LCD device 100 is better than conventional LCD.

By contrast, the present inventive LCD device provides a novelty pixel matrix in cooperation with a method of driving the pixel matrix, the vision of the checker-like MURA is more comfortable than that of the straight-line-like MURA. As a consequence, not only a drawback of the straight-line-like MURA which is caused by the conventional LCD device having pixel matrix arranged in a zigzag pixel design and using half source driver (HSD) technique, is avoided, but the checker-like MURA is hardly visible.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A liquid crystal display comprising a pixel matrix, the pixel matrix comprising:

a first scan line, a second scan line, and a third scan line, arranged in parallel to each other, and a data line;

at least two first pixel groups, neighbored with each other and at one side of the data line, each first pixel group comprising a first pixel and a second pixel; and at least two second pixel groups, neighbored with each other and at the other side of the data line, each second pixel group comprising a third pixel and a fourth pixel;

wherein the first pixel comprises a first active element coupled to the first scan line and the data line, the second pixel comprises a second active element coupled to the second scan line and the first active element, the third pixel comprises a third active element coupled to the second scan line and the data line, the fourth pixel comprises a fourth active element coupled to the third scan line and the third active element;

wherein the at least two first pixel groups and the at least two second pixel groups are driven depending on the following order:

one of the at least two second pixel groups is driven to transmit a first signal to the fourth pixel and a second signal to the third pixel via the data line;

another second pixel group is driven to transmit the first signal to a fourth pixel and the second signal to the third pixel via the data line;

one of the at least two first pixel groups is driven to transmit a third signal to the second pixel and a fourth signal to the first pixel via the data line; and another first pixel group is driven to transmit the third signal to the second pixel and the fourth signal to the first pixel via the data line.

2. The liquid crystal display of claim 1, wherein the pixel matrix is arranged in a zigzag pixel design.

3. A liquid crystal display comprising a pixel matrix, the pixel matrix comprising:

a first scan line, a second scan line, and a third scan line, arranged in parallel to each other, and a data line;

at least two first pixel groups, neighbored with each other and at one side of the data line, each first pixel group comprising a first pixel and a second pixel; and at least two second pixel groups, neighbored with each other and at the other side of the data line, each second pixel group comprising a third pixel and a fourth pixel;

wherein the first pixel comprises a first active element coupled to the first scan line and the data line, the second pixel comprises a second active element coupled to the second scan line and the first active element, the third pixel comprises a third active element coupled to the second scan line and the data line, the fourth pixel comprises a fourth active element coupled to the third scan line and the third active element;

wherein the at least two first pixel groups and the at least two second pixel groups are driven depending on the following order:

one of the at least two second pixel groups is driven to transmit a first signal to the fourth pixel via the data line;

one first pixel of one of the at least two first pixel groups is driven to transmit a second signal to the first pixel via the data line;

another second pixel group is driven to transmit a third signal to another fourth pixel via the data line; and the third pixel of the at least two second pixel group is driven to transmit a fourth signal to the third pixel via the data line.

4. The liquid crystal display of claim 3, wherein the step of driving one of the at least two second pixel groups comprises providing a scan signal to the third active element and the fourth active element of the driven second pixel group, simultaneously.

5. The liquid crystal display of claim 4, wherein the step of driving another second pixel group comprises providing another scan signal to the third active element and the fourth active element of the driven second pixel group, simultaneously.

6. The liquid crystal display of claim 3, wherein the pixel matrix is arranged in a zigzag pixel design.

* * * * *